US006510803B1

(12) United States Patent
Agee

(10) Patent No.: US 6,510,803 B1
(45) Date of Patent: Jan. 28, 2003

(54) HEIGHT ADJUSTABLE TABLE

(75) Inventor: William Michael Agee, Huntersville, NC (US)

(73) Assignee: Baker Manufacturing Company, Inc., Pineville, LA (US)

( * ) Notice: Subject to any disclaimer, the term of this patent is extended or adjusted under 35 U.S.C. 154(b) by 0 days.

(21) Appl. No.: 09/718,305

(22) Filed: Nov. 21, 2000

(51) Int. Cl.[7] ..... A47B 9/00
(52) U.S. Cl. ..... 108/147
(58) Field of Search ..... 108/144.11, 146, 108/147, 147.19, 190; 248/188.5, 188.1, 162.1, 404

(56) References Cited

U.S. PATENT DOCUMENTS

| | | | | |
|---|---|---|---|---|
| 544,836 A | | 8/1895 | Vetter | |
| 1,243,750 A | | 10/1917 | Miller | |
| 2,532,342 A | | 12/1950 | Sloane | |
| 2,642,996 A | | 6/1953 | Oeler et al. | |
| 2,982,050 A | | 5/1961 | May | |
| 3,140,559 A | | 7/1964 | Grow et al. | |
| 3,273,517 A | | 9/1966 | Amthor, Jr. et al. | |
| 3,364,881 A | | 1/1968 | Kooi | |
| 3,638,584 A | | 2/1972 | Cisler | |
| 3,820,176 A | | 6/1974 | Feiertag | |
| 3,887,155 A | | 6/1975 | Bertalot | |
| 3,908,560 A | | 9/1975 | Horner | |
| 4,130,069 A | | 12/1978 | Evans et al. | |
| 4,591,214 A | | 5/1986 | Reuter et al. | |
| 4,619,208 A | | 10/1986 | Kurrasch | |
| 4,637,322 A | | 1/1987 | Hampshire et al. | |
| 4,751,884 A | | 6/1988 | Ball | |
| 4,981,085 A | | 1/1991 | Watt | |
| 5,041,770 A | | 8/1991 | Seiler et al. | |
| 5,289,782 A | | 3/1994 | Rizzi et al. | |
| 5,322,025 A | | 6/1994 | Sherman et al. | |
| 5,323,695 A | | 6/1994 | Borganan | |
| 5,339,750 A | | 8/1994 | Smies | |
| 5,370,063 A | | 12/1994 | Childers | |
| 5,394,809 A | * | 3/1995 | Feldpausch et al. | 108/144.11 |
| 5,408,940 A | | 4/1995 | Winchell | |
| 5,447,099 A | * | 9/1995 | Adams et al. | 108/147 |
| 5,546,873 A | * | 8/1996 | Conner et al. | 108/153 |
| 5,706,739 A | * | 1/1998 | Shaheen et al. | 108/147 |
| 5,819,669 A | | 10/1998 | Eyre | |
| 6,062,148 A | * | 5/2000 | Hodge et al. | 108/147 |
| 6,119,989 A | * | 9/2000 | Hollington et al. | 248/188.2 |

FOREIGN PATENT DOCUMENTS

| | | | |
|---|---|---|---|
| NL | 8801157 | * 12/1989 | 108/147 |

* cited by examiner

*Primary Examiner*—Janet M. Wilkens
(74) *Attorney, Agent, or Firm*—Garvey, Smith, Nehrbass & Doody, L.L.C.; Charles C. Garvey, Jr.

(57) ABSTRACT

A height adjustable table includes a frame that has a pair of spaced apart, generally vertical frame sections, each supported upon a foot, a transverse, generally horizontal section that connects at its end portions to the vertical sections and a pair of lifts that are supported by the vertical frame sections to. elevate between extended, higher elevational and retracted, lower elevational positions. The lifts support a table top with a work surface. The frame is in the form of a universal base that accepts a number of different mechanism including, for example, a counterbalance mechanism, a motor drive mechanism, and a manually operable mechanism. These mechanisms can be selected by a user, depending upon the type of table that is to be manufactured. This enables the user to pick and choose a mechanism so that the manufacturer can use the same universal base in the construction of three different table designs. A plurality of panels are provided that cover the frame. These panels can also be selected by an end user to define an ornamental look and/or a selected color pattern.

32 Claims, 3 Drawing Sheets

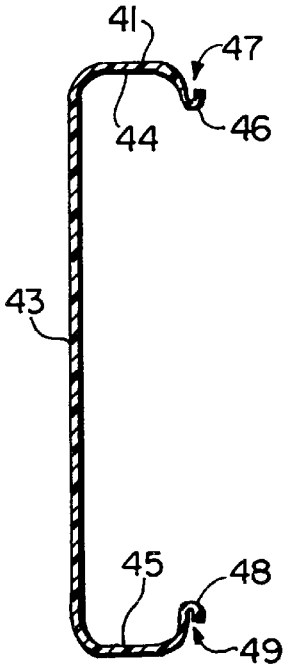
FIG. 2.
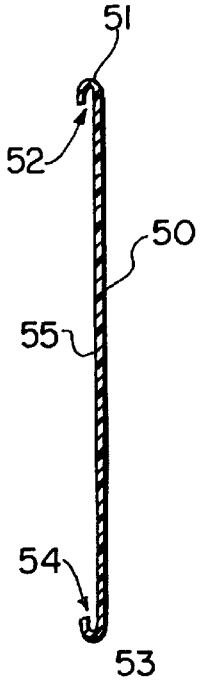
FIG. 3.
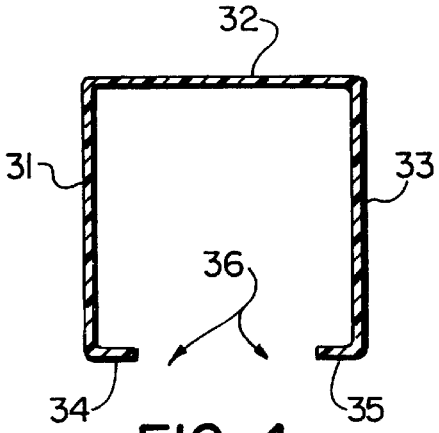
FIG. 4.
FIG. 8.
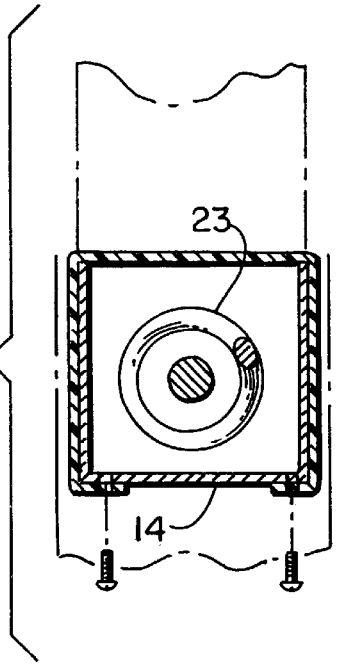
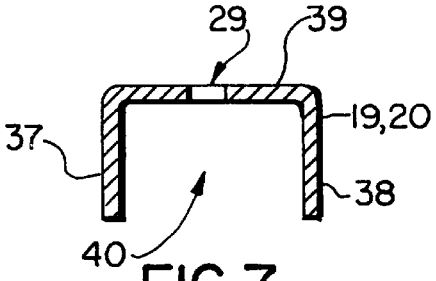
FIG. 7.

HEIGHT ADJUSTABLE TABLE

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to adjustable tables, more particularly, tables having a work surface that can carry heavy objects and yet be adjusted into multiple elevational positions. Even more particularly, the present invention relates to an improved adjustable height table having an internal base that can accept different panels to give the table an alternate ornamental appearance if desired.

2. General Background of the Invention

Adjustable tables have been in use for many years. There are several adjustable height tables that are commercially available. Several of these adjustable height tables were patented as drafting tables. Several of these patents and commercially available tables were sold under the trademark Hamilton.

One of the primary uses for adjustable height tables is the support of a heavy object such as a computer and/or monitor at a comfortable elevation for the user. Because computers and monitors are relatively heavy, a problem exists when the table is at a maximum elevational position such as when the user chooses to stand. In such a situation, adjustable height tables can become top heavy and suffer from lateral instability. The weighted table top of the table tends to deflect when it is elevated to a high position and when it is loaded with a heavy object such as a monitor, computer or the like.

Many patents have issued that are directed to elevating or height adjustable tables. Examples include patents relating to Hamilton® drafting tables that have been sold for many years (see U.S. Pat. Nos. 3,140,559 and 3,273,517).

Early patents that show adjustable height tables are shown for example in U.S. Pat. Nos. 544,836; 1,243,750; 2,532,342; and 2,642,996;

The May Patent discloses an adjustable support for a drafting table. In the May U.S. Pat. No. 2,982,050, an adjustable drafting board support that includes a pair of links that swing to elevate and lower the board and an improved arrangement for counterbalancing the board to apply a substantially uniform lift to the board in all operative positions.

The Grow U.S. Pat. No. 3,140,559 in each one discloses a drafting table that uses a rack and pinion arrangement in combination with a locking or braking mechanism which is adapted to lock the vertically adjustable table in any selected position when the operating linkage has been released and which lock will become even more securely locked upon the application of downward pressure on the table top occurring in normal use.

The Kooi U.S. Pat. No. 3,364,881 discloses a drafting table with a single pedal control of both vertical movement and tilting.

U.S. Pat. No. 3,638,584 discloses a drafting table that includes a pedestal, support columns associated with the pedestal for vertical movement and a drafting board on an upper portion thereof. An elevating table is disclosed in the Feiertag U.S. Pat. No. 3,820,176.

A telescoping support arm of quadrangular cross-section is disclosed in the Bertalot U.S. Pat. No. 3,887,115. The apparatus provides roller bearings in corner spaces between each tube surrounding each other, the rollers in one corner rolling over separate braces supported on resilient means urging the rollers and the inner tube toward the other corner so as to exclude backlash.

The Horner U.S. Pat. No. 3,908,560 discloses a counter balancing system for a drafting table. A vertically adjustable drafting table is disclosed in the Evans U.S. Pat. No. 4,130,069.

The Raymond U.S. Pat. No. 4,469,029 discloses a workstation comprised of support legs with a stable support base and the uprights on which pivoting elbows are adapted to form adjacent arms which are positioned and locked in place in an adjustable angular manner at one of these end of the arms, the other end bearing supports are work tops positioned and locked in place in a manner which can be angularly adjusted at will, so that these supports or work tops allow effects and uses which are multiple and can be combined together.

U.S. Pat. No. 4,591,214 issued to Reuter discloses a cabinet closure assembly that includes a panel which is pivotable between opening-blocking and opening-unblocking positions. The Kurrasch U.S. Pat. No. 4,619,208 discloses a work surface height adjustment mechanism.

An adjustable computer work table is disclosed in U.S. Pat. No. 4,637,322. Vertically actuating scissor arms are provided for moving the support shaft upward and downward whereby providing a vertical adjustment.

The Ball U.S. Pat. No. 4,751,884 discloses a height adjustable work top. The work top is adjustable and may tilt about a horizontal axis near the front edge. The work top may be mounted in an open office beam system or an office screen or partition in cantilever fashion or it may be a free standing unit.

A table lift mechanism is disclosed in the Watt U.S. Pat. No. 4,981,085. The '085 Patent discloses furniture having a top or the like supported for vertical movement by telescoping legs supports with a counter balance for exerting a relatively uniform counter balance force from the top throughout its range of vertical movement. A latch mechanism is provided for latching the top in the selected vertical positions, and an adjustable roller guide mechanism as provided for coupling the telescoping elements of the legs supports.

An apparatus for adjusting a computer work station to individual needs is disclosed in the Seiler U.S. Pat. No. 5,041,770.

An adjustable height table is disclosed in the Rizzi U.S. Pat. No. 5,289,782. The '782 Patent discloses a table having a top that can be vertically adjusted to various heights by a pair of telescoping legs and a counter balance weight mechanism which includes a weight box and weights that can be easily added or removed by the user depending on the weight carried by the table top. A locking mechanism including a spring urged threaded half nut and a stationary threaded rod enables the table top to be locked in place once a desired height is achieved.

An adjustable dual work surface support is disclosed in the Sherman, et al, U.S. Pat. No. 5,332,025. The Borgman, et al, U.S. Pat. No. 5,323,695 discloses a method of using a work station having separate and back tops having separate power drive arrangements while permitting independent height adjustment. A controller, which is programed by an operator, permits storage of a number of predetermined height locations each defining distinct heights for the tops. The operator effects programed movement of the tops to predetermined height locations for predetermined times in a predetermined sequence, with the rear top moving initially and a front top moving thereafter.

The Smies U.S. Pat. No. 5,339,750 discloses an adjustable work table. The '750 Patent table comprises a base and at least one movable extensible vertical column attached to the base having a table top carried on the vertical column. A pivot is provided for moving the table top into any of a range of pivoted positions, preferably on both sides of the horizontal position of the table top. A motor is provided for holding the table top in any of the range of pivoted positions.

A non-binding cantilevered table lifting device disclosed in the Childers U.S. Pat. No. 5,370,063.

The Winchell U.S. Pat. No. 5,408,940 discloses an adjustable height work surface with rack and pinion arrangements.

BRIEF SUMMARY OF THE INVENTION

The present invention provides an improved, height adjustable table apparatus that includes a frame that has a pair of spaced apart generally vertical frame sections and a generally horizontal section that connects at its end portions to the vertical sections. A pair of feet are provided for supporting the respective vertical frame sections.

A pair of lifts are supported by the vertical frame section, each lift being supported by one of the vertical frame sections.

A table top is supported by the lifts so that the table top can be raised or lowered to a selected elevational position such as, for example, when a user has equipment on the work surface such as a computer.

A mechanism is fitted to the frame and includes a drive that elevates the lifts relative to the frame and thus the table top.

A plurality of panels are provided that removably cover the frame, wherein the panels include two separate interlocking panel sections that cover each vertical frame section, a horizontal panel that covers the horizontal section and sections that cover the feet.

The plurality of panels thus preferably include vertical panels, horizontal panels, and interlocking portions that join at least some of the panels together.

The frame is configured to receive a selected mechanism of a plurality of different mechanisms.

One of the mechanisms can be a counterbalanced spring mechanism. One of the mechanisms can include a motor drive. One of the mechanisms can be a manually operable mechanism such as a crank mechanism.

The mechanism can include a rotary shaft that is rotatable such as for example, manually rotatable or driven by the motor drive.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 2 is a sectional view taken along lines 2—2 of FIG. 1;

FIG. 3 is a sectional view taken along lines 3—3 of FIG. 1;

FIG. 4 is a sectional view taken along lines 4—4 of FIG. 1;

FIG. 7 is a sectional view taken along lines 7—7 of FIG. 6;

FIG. 8 is a sectional view taken along lines 8—8 of FIG. 5.

DETAILED DESCRIPTION OF THE INVENTION

Figure 1:
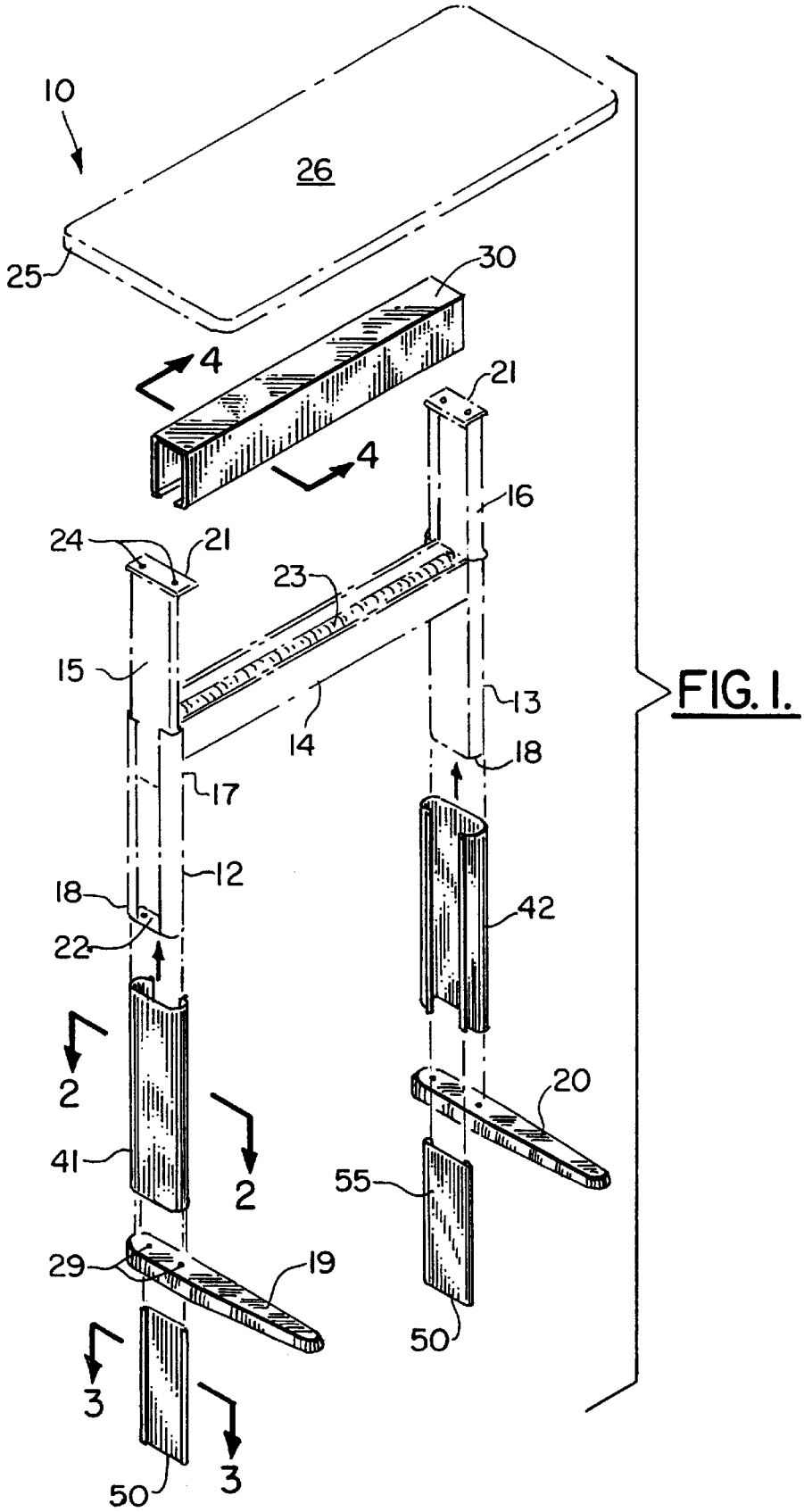
FIG. 1 is an exploded, perspective view of the preferred embodiment of the apparatus of the present invention.
Figure 5:
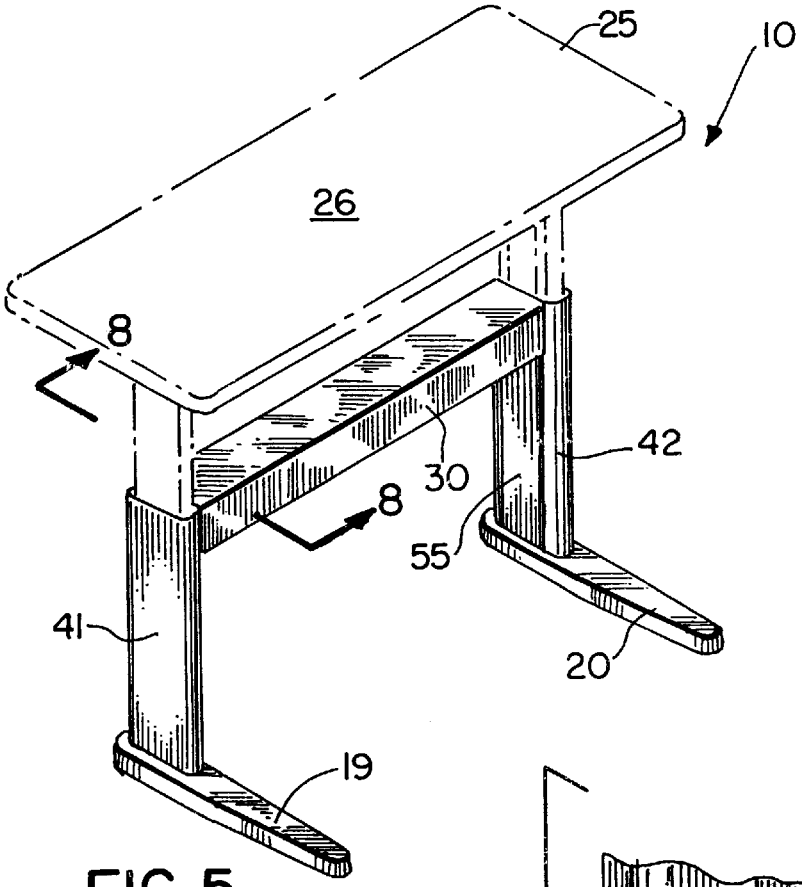
FIG. 5 is a perspective view of the preferred embodiment of the apparatus of the present invention.

FIGS. 1–8 show the preferred embodiment of the apparatus of the present invention designated generally by the numeral 10 in FIGS. 1 and 5. Table apparatus 10 includes a base 11 that is a universal base 11 that can be fitted with a selected mechanism of a plurality of mechanisms. In the preferred embodiment, these mechanisms can include, for example, a counterbalance spring mechanism, a motor driven mechanism, and a hand crank manually operable mechanism.

The base 11 includes vertical supports 12 and 13 that are spaced apart and held in spaced relationship by horizontal support 14. Base 11 can be thus of welded steel construction.

A pair of spaced apart lifts 15, 16 define an elevating portion that moves up and down with table top 25. Table top 25 can be attached by bolting or like fasteners to table top 25.

Each of the lifts 15, 16 provides a lower end 17, 18 respectively. Each of the lower end portions 17, 18 carries a foot 19, 20 respectively.

Plates 21 are provided at the upper end portion of each lift 15, 16. Plates 22 are provided at the lower end 18 of each of the lifts 15, 16. These plates 21, 22 have openings 24, 27 that enable the frame 11 to be attached (for example bolted) to spaced apart feet 19, 20 and to table top 25.

Figure 6:
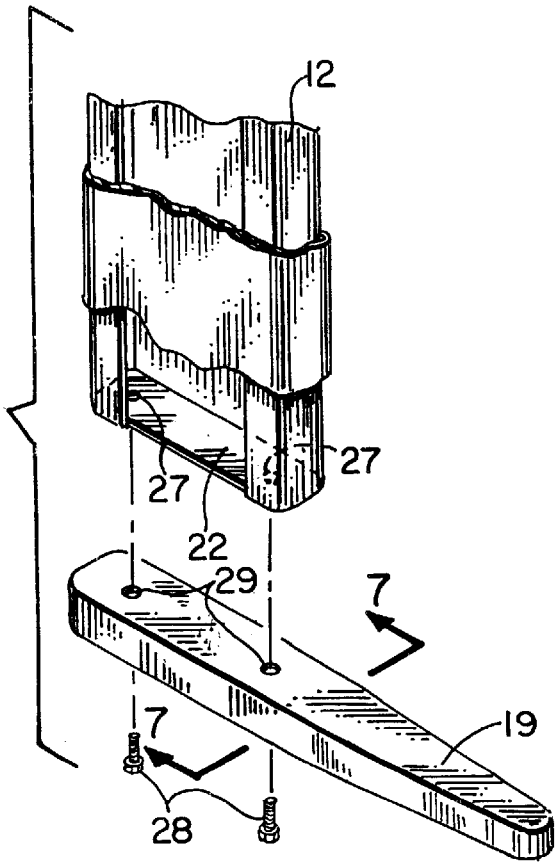
FIG. 6 is a partial, perspective view of the preferred embodiment of the apparatus of the present invention illustrating particularly the lower end of a vertical frame member and the foot portion.

A mechanism 23 is provided for assisting a user in the elevating or lowering of table top 25 during use. As shown in FIGS. 1 and 6, a vertical slot 56 enables access to the interior 57 of each vertical support 12, 13 and the openings 27. After assembling covers 41, 42 to base 11, slots 56 are covered with covers 41, 42 as shown in FIGS. 5 and 6. The mechanism can include for example a counter balance spring mechanism, a motor drive, or a hand crank. Thus, the frame 11 is configured to accept a plurality of different mechanisms depending upon selection by a user.

Openings 24 in each plate 21 enable fasteners such as wood screws or bolts to attach table top 25 to lifts 15, 16. Table top 25 provides a work surface 26 that can be used to support any of a number of heavy objects such as a computer, computer monitor, books or other published material or the like.

Plates 22 at the lower end of each vertical support 12, 13 of base 11 enable fasteners such as assembly screws 28 to be used to fasten each of the feet 19, 20 to respective vertical support sections 12, 13 of base 11. Openings 29 in each of the feet 19, 20 receive assembly screws 28 upon assembly of the feet 19, 20 to the respective vertical supports 12, 13 at plates 22.

Horizontal support 14 receives horizontal cover 30. The horizontal cover 30 is shown in FIGS. 4–5 as including side wall 31, top wall 32, side wall 33, and longitudinally extending flanges 34, 35. A slot 36 is defined by the space in between flanges 34, 35. Horizontal support 30 is preferably of a relatively thin material so that it can be flexed. Thus, the flanges 34, 35 can be moved apart enlarging slot 36 so that the entire horizontal cover 30 can fit over and cover horizontal support 14 of base 11 as shown in FIG. 1 and the installed position of FIG. 5. FIGS. 1 and 7 show more particularly each of the feet 19, 20 that are used to support base 11 and the overall table apparatus 10. Each foot 19, 20 includes side walls 37, 38 and top wall 40. A recess 40 can be provided that enables a manufacturer to gain access to opening 29 when attaching a foot 19 or 20 to its vertical support 12, 13 at the lower end portion of base 11. Recess 40 thus enables easy access to opening 29 during assembly.

A plurality of covers are provided for covering frame 11. These include vertical covers 41, 42 and vertical connecting panels 50. Vertical cover 41 is shown in FIGS. 1 and 2. The vertical covers 41, 42 each provide an enlarged generally rectangular vertical plate 43 that supports a pair of spaced apart curved flanged portions 44, 45. Each flange 44, 45 carries a curved connector 46 having a slot 47 that forms a connection with a projecting portion 52 of vertical connecting panels 50. In FIG. 3, vertical connecting panel 50 has curved connectors 51, 53 that are spaced apart and along opposing edges of the panel 50, each of which provides a projection or projecting portion 52, 54 respectively. The vertical connecting panel 50 is primarily comprised of a large, vertically extending generally rectangular plate 55 as shown in FIGS. 1, 3 and 5.

The following is a list of parts and materials suitable for use in the present invention:

PARTS LIST

10 table apparatus
11 base
12 vertical support
13 vertical support
14 horizontal support
15 lift
16 lift
17 upper end
18 lower end
19 foot
20 foot
21 plate
22 plate
23 mechanism
24 opening
25 table top
26 work surface
27 opening
28 assembly screw
29 opening
30 horizontal cover
31 side wall
32 top wall
33 side wall
34 flange
35 flange
36 slot
37 side wall
38 side wall
39 top wall
40 recess
41 vertical cover
42 vertical cover
43 vertical plate
44 flange
45 flange
46 curved connector
47 slot
48 curved connector
49 slot
50 vertical connecting panel
51 curved connector
52 projection
53 curved connector
54 projection
55 vertical plate
56 vertical slot
57 interior The foregoing embodiments are presented by way of example only; the scope of the present invention is to be limited only by the following claims.

What is claimed is:

1. A height adjustable table apparatus, comprising:

a) a structural frame that includes a pair of spaced apart generally vertical load bearing frame sections, each having a vertical slot and each supported upon a foot, each vertical load bearing frame section comprised of a plurality of flanges, at least two flanges being provided opposite said vertical slot, the structural frame including a transverse, generally horizontal load bearing section that connects at its end portions to the vertical load bearing frame sections, said vertical load bearing frame sections and said horizontal load bearing sections including a plurality of panels, some that define a plurality of sides;

b) the structural frame including a pair of lifts, each lift being supported by one of said vertical load bearing frame sections;

c) a table top supported by the lifts;

d) a mechanism that elevates the lifts relative to the vertical load bearing frame sections; and e) a plurality of non-load bearing, removable panels that cover at least part of the structural frame, wherein the non-load bearing panels include two separate panel sections that cover the vertical load bearing-frame sections, each removable panel having a vertical plate and at least two flanged portions connected to the vertical plate.

2. The height adjustable table of claim 1 wherein the plurality of panels include vertical panels, horizontal panels, and interlocking portions that Join some of the panels together.

3. The height adjustable table of claim 2 wherein the selected mechanism includes a rotary shaft that is contained within the horizontal section.

4. The height adjustable table of claim 1 wherein the frame is configured to receive a selected mechanism of a plurality of different mechanisms.

5. The height adjustable table of claim 4 wherein the selected mechanism includes a counterbalance spring.

6. The height adjustable table of claim 4 wherein the selected mechanism includes a motor drive.

7. The height adjustable table of claim 1 further comprising a non-load bearing, removable panel section that covers the transverse, generally horizontal section.

8. A height adjustable table apparatus, comprising:

a) a structural frame that includes a pair of spaced apart generally vertical frame sections each supported upon a foot, a transverse, generally horizontal frame section that connects at its end portions to the vertical frame sections, said vertical and horizontal sections including structural load bearing panels that define a plurality of sides;

b) a pair of lifts, each lift being supported by one of the vertical frame sections;

c) a table top supported by the lifts;

d) a mechanism that elevates the lifts relative to the frame; and e) a plurality of non-load bearing, removable panels that cover the base including separate panels for covering the vertical and the horizontal frame sections, each said removable panel including a plate and at least two flanged portions connected to the plate for covering at least three sides of said vertical or said horizontal frame section.

9. The height adjustable table of claim 8 wherein the non-load bearing panels include two separate interlocking panel sections that cover each vertical frame section.

10. The height adjustable table of claim 8 wherein the frame is configured to receive a selected mechanism of a plurality of different mechanisms.

11. The height adjustable table of claim 8 wherein the mechanism includes a counterbalance spring.

12. The height adjustable table of claim 8 wherein the mechanism includes a motor drive.

13. The height adjustable table of claim 8 wherein the mechanism is manually operable.

14. The height adjustable table of claim 8 wherein the mechanism includes a rotary shaft.

15. The height adjustable table of claim 8 wherein the panels include a plurality of panel sections including at least one panel section that covers the transverse, generally horizontal section.

16. A height adjustable table apparatus, comprising:

a) a structural frame that includes a pair of spaced apart generally vertical load bearing frame sections each supported upon a foot, a transverse, generally horizontal load bearing section that connects at its end portions to the vertical sections, said vertical frame sections and said horizontal load bearing section including structural load bearing panels that define a plurality of sides;

b) a pair of lifts, each lift being supported by a vertical frame section;

c) a table top supported by the lifts;

d) a mechanism that elevates the lifts relative to the frame; and e) a plurality of non-load bearing, removable panels that cover the frame wherein the non-load bearing panels include two separate panel sections that cover the vertical frame sections and a non-load bearing panel that covers the generally horizontal section, at least some of the panels being separate panels that connect together.

17. The height adjustable table of claim 16 wherein the plurality of panels include vertical panels, horizontal panels, and interlocking portions that join some panels together.

18. The height adjustable table of claim 16 wherein the frame is configured to receive a selected mechanism of a plurality of different mechanisms.

19. The height adjustable table of claim 18 wherein the mechanism includes a counterbalance spring.

20. The height adjustable table of claim 18 wherein the mechanism includes a motor drive.

21. The height adjustable table of claim 20 wherein the mechanism includes a rotary shaft that is contained within the horizontal section.

22. The height adjustable table of claim 16 further comprising a non-load bearing removable panel section that covers the transverse, generally horizontal section.

23. A height adjustable table apparatus, comprising:

a) a structural frame that includes a pair of spaced apart generally vertical frame sections each supported upon a foot, a transverse, generally horizontal frame section that connects at its end portions to the vertical frame sections, said vertical and horizontal sections including structural load bearing panels that define a plurality of sides;

b) a pair of lifts, each lift being supported by one of the vertical frame sections;

c) a table top supported by the lifts;

d) a mechanism that elevates the lifts relative to the frame; and e) a plurality of non-load bearing, removable panels that cover the base including separate panels for covering the vertical and the horizontal frame sections, each said cover including a plate and at least two flanged portions connected to the plate for covering at least three sides of said vertical or horizontal frame sections.

24. The height adjustable table of claim 23 wherein the non-load bearing panels include two separate interlocking panel sections that cover each vertical frame section.

25. The height adjustable table of claim 23 wherein the frame is configured to receive a selected mechanism of a plurality of different mechanisms.

26. The height adjustable table of claim 23 wherein the mechanism includes a counterbalance spring.

27. The height adjustable table of claim 23 wherein the mechanism includes a motor drive.

28. The height adjustable table of claim 23 wherein the mechanism is manually operable.

29. The height adjustable table of claim 23 wherein the mechanism includes a rotary shaft.

30. The height adjustable table of claim 23 wherein the panels include a plurality of panel sections including at least one panel section that covers the transverse, generally horizontal section.

31. A height adjustable table apparatus, comprising:

a) a static load bearing frame that includes a pair of spaced apart generally vertical load bearing frame sections, each having a vertical slot, each vertical frame section comprised of a plurality of flanges;

b) the load bearing frame including a transverse, generally horizontal load bearing section that connects to each of the vertical frame sections, said vertical slots being positioned on said vertical load bearing sections opposite said horizontal load bearing section, the frame including a hollow interior portion;

c) a pair of movable lifts, each lift being supported by one of said vertical frame sections and movable with respect to the vertical frame section between lowered and elevated positions;

d) a table top attached to and supported by the lifts;

e) a mechanism that elevates the lifts relative to the frame, at least some of the mechanism occupying the frame hollow interior portion; and f) a plurality of non-load bearing, removable panels that cover the static load bearing frame, wherein the non-load bearing panels include at least two separate panel sections that cover the vertical frame sections and a non-load bearing panel that covers the generally horizontal section, wherein one of said non-load bearing panels covers each vertical slot.

32. A height adjustable table apparatus, comprising:

a) a structural frame that includes a pair of spaced apart generally vertical frame sections, each supported upon a foot;

b) the frame including a transverse, generally horizontal frame section that connects at its end portions to the vertical frame sections, said vertical and horizontal sections including structural load bearing panels that define a plurality of sides;

b) a pair of lifts, each lift being supported by one of vertical frame sections;

c) a table top supported by the lifts;

d) a mechanism that elevates the lifts relative to the frame; and e) a plurality of non-load bearing, removable panels that cover the base including two separate interlocking panels for covering each vertical frame section and a panel for covering the horizontal frame section, at least some of the panels having a plate and at least two flanged portions connected to the plate for covering at least three sides of one of said frame sections.

* * * * *